United States Patent [19]

Bishop

[11] 4,360,354

[45] Nov. 23, 1982

[54] MACHINE FOR THE TREATMENT OF WEB MATERIAL

[75] Inventor: Thomas D. Bishop, Solihull, England

[73] Assignee: The Deritend Engineering Co. Ltd., England

[21] Appl. No.: 190,521

[22] PCT Filed: Jul. 17, 1979

[86] PCT No.: PCT/GB79/00117

§ 371 Date: Mar. 17, 1980

§ 102(e) Date: Mar. 17, 1980

[87] PCT Pub. No.: WO80/00231

PCT Pub. Date: Feb. 21, 1980

[30] Foreign Application Priority Data

Jul. 17, 1978 [GB] United Kingdom ..... 30101/78
Jul. 18, 1978 [GB] United Kingdom ..... 30251/78

[51] Int. Cl.[3] ..... B31B 1/16

[52] U.S. Cl. ..... 493/22; 83/303; 73/324; 493/362

[58] Field of Search ..... 83/324, 303, 311, 313, 83/354, 295; 493/11, 22, 362, 361, 60, 64; 101/93.08, 93.07

[56] References Cited

U.S. PATENT DOCUMENTS 2,599,430 6/1952 Beuerman ..... 83/324 X
3,347,119 10/1967 Sarka ..... 83/303 X
3,424,041 1/1969 Giraud ..... 83/324 X
3,448,646 6/1969 Bishop ..... 83/324 X
3,745,865 7/1973 Johnson ..... 83/324 X
4,009,628 3/1977 Kato ..... 83/303 X

FOREIGN PATENT DOCUMENTS 2657861 6/1978 Fed. Rep. of Germany ..... 83/324
1174042 12/1969 United Kingdom .

*Primary Examiner*—James F. Coan
*Attorney, Agent, or Firm*—C. O. Marshall, Jr.

[57] ABSTRACT

A die-cutting machine comprises two form-carrying rolls (10,12) operable in timed relation to produce alternate blanks, with minimum wastage between the blanks, from a web fed at constant speed by a conventional feed mechanism (14). The rolls (10,12) are driven by computer-controlled variable speed high impulse duty D.C. motors (28, 30) supplied with electrical power from thyristor controlled power supplies (36,38). Sensors (18, 24, 26) provide feedback signals representing web speed and instantaneous roll positions and speeds to the programmable computer units (32, 34). The use of the computer-controlled D.C. motors avoids backlash problems in previously proposed mechanical drives and allows greater flexibility, especially in maintaining registration between the rolls and preprinted areas on the web. A flywheel arrangement is employed to reduce the loading on the motors during large variations in roll speed.

11 Claims, 10 Drawing Figures

MACHINE FOR THE TREATMENT OF WEB MATERIAL

BACKGROUND OF THE INVENTION

This invention relates to a machine for the treatment of continuous web in the production of a series of (usually) identical areas of the web which are closely spaced along the length of the web. The invention is especially useful in die-cutting to produce separate blanks which can be stripped from the web, for example in the manufacture of printed cardboard boxes, in which case the die cuts may need to be accurately synchronised with pre-printed areas on the web. (If for example boxes and lids are produced alternately from the same web, this will give rise to the case where consecutive blanks are not identical). The invention may also be used in the printing of such areas, and for convenience in this specification, the word "blanks" will be used for both situations.

In order to achieve high speed production, possibly at a rate of thousands of blanks per hour, the treatment is effected by rotary rolls which carry the die-cutting forms or printing stereos (collectively called "forms" herein) and the surface speed of these is matched to that of the web.

In a simple hypotehtical case the web and roll may run at constant speed, but then the blanks will only be closely spaced along the web if the peripheral dimension of the roll (P) is equal to or slightly more than the length (L) of each blank.

The users of such a machine may need to switch from one blank size to another quite frequently, but the only theoretical possibility with such a simple machine would be to change the roll diameter so that factor P of the new roll continued to be equal to or slightly more than the dimension L of the new blank. This is not a practical possibility.

It has therefore been proposed in British Pat. No. 1093723 to duplicate the roll (and for the purpose of explanation of the theory behind this it will be assumed that the rolls then have a periphery equal to 2 P, although this is not a necessity). The two rolls are then synchronised in phase relative to the web and effectively the leading one of each two adjacent blanks is produced by one roll and the trailing one by the other roll. When new blanks of different lengths are to be produced, the new formes are mounted on the rolls and, according to said patent, the speed of the web or the speed of the rolls is varied, once in each cycle, and this is done during the portion of the cycle when the forms are out of contact with the web. Thus if the new length L is greater than before, the web has to be accelerated and then retarded to the matched speed, or the rolls have to be retarded and then accelerated to the matched speed: if the new length L is less than before, vice versa.

Said patent proposes epicyclic gears for roll speed variation but this is complex and may be subject to difficulties in achieving accuracy because of back-lash or play in the gear system. It is also expensive to produce. The object of the invention is to provide new means for roll speed variation which avoid these problems.

SUMMARY OF THE INVENTION

In accordance with one aspect of the invention we provide a machine for treating continuous web in the production of a series of blanks in, on or from the web of the kind comprising at least two sets of treatment rolls for co-operation with the web and means for varying the roll speed whereby close spacing of the blanks can be achieved even when the blank length departs from close approximation to half of the roll periphery, characterised in that the said means comprise a drive motor and electronic means for cyclically varying the speed of the motor under computer control so as to lead to positional accuracy and matched speed of the forms with the web.

It will be appreciated by those skilled in the art that the permissible extent of the divergence of the length of the blanks from half the peripheral dimension of the roll depends upon the capability of the motor to accelerate and retard in the time available, since the roll must run at web speed during the actual treatment portion of each roll revolution.

Whilst reference is made to two sets of rolls, it would also be possible to use more, for example three sets of rolls, and in all cases a possibility exists of producing blanks greater in length than the periphery of a single roll, by producing for example half of each blank from each roll and using the invention to maintain close spacing between successive blanks.

In general, each roll set will comprise a treatment roll, e.g. a printing roll or die-cutting roll, and a second counterpressure roll which forms a nip with the treatment roll, is of plain cylindrical form and runs at constant speed, matched to web speed.

In accordance with a second aspect of the invention we provide a machine for treating continuous web in the production of a series of longitudinally successive blanks in, on or from the web, comprising at least two sets of treatment rolls each including a forme for co-operation with the blank, means for rotatably driving the roll sets, means for feeding the web at substantially constant speed along a predetermined path through the nips of said roll sets and means for co-ordinating operation of said roll sets with each other and with said feed means such that alternate blanks are produced by the forme of a respective roll set with substantially no wastage between adjacent blanks, characterised in that said drive means comprises a variable speed electrical drive motor associated with each roll set and said co-ordinating means comprises programmable computing means responsive to position and speed feedback signals from the form-carrying rolls for controlling said drive motors whereby each form-carrying roll is driven at a peripheral speed substantially the same as the web speed throughout engagement of the respective form with the web and in accordance with a programmed variable speed pattern for the remaining part of each roll revolution.

The apparatus of the present invention is intended for use in the production of a wide range of blank sizes so that at one extreme the form of each roll will occupy considerably more than 180° of arc and at the other extreme the form will occupy somewhat less than 180° of arc. In the former case, to minimise or eliminate wastage between blanks the roll speed must be considerably reduced (and possibly brought to a standstill or reversed) during the time that the form is disengaged and then brought back to web speed as the form leading edge approaches the web for the next operation. In the latter case, the roll speed must be considerably increased during the form-disengaged part of the roll revolution and then brought back to web speed immediately before the form re-engages the web. It will be appreciated therefore that owing to the large masses of the roll, form and associated gear, the electrical motors are subjected to heavy impulse loading during such variations in speed.

Although variable speed D.C. motors, specially designed for high impulse duty, are commercially available, the size of motor required to meet such extremes would be costly compared to a mechanical drive such as that contemplated in British Pat. No. 1093723. Moreover because of the large speed increases and reductions involved over relatively short periods of time, the efficiency of operation in terms of electrical power consumption would be poor owing to heating effects of the large electric currents handled.

To enable comparatively small electrical motors to be employed and at the same time improve the efficiency of power consumption, according to a preferred aspect of the invention the apparatus defined above further includes auxiliary means associated with each roll to assist variation of the rotational speed of each form-carrying roll by said motors during said remaining part of each roll revolution.

In the preferred embodiment said auxiliary means comprises, for each form-carrying roll, a flywheel, means for rotating the flywheel with a peripheral speed which is matched with web speed while the form of the respective roll is engaged with the web, and coupling means operable during said remaining part of the roll revolution to couple the flywheel to the respective form-carrying roll in such a way that the flywheel speed tends to increase or decrease with respect to the roll speed whereby, owing to conservation of angular momentum, the roll speed is correspondingly decreased or increased.

Thus, when the form-carrying roll is to be slowed down for example, the arrangement may be such that via the coupling the flywheel is pushed in the forward direction thereby tending to increase its speed relative to the roll whose speed decreases, owing to conservation of angular momentum, independently of the braking action of the respective motor. Consequently the demand made on the motors is correspondingly reduced.

DESCRIPTION OF THE PREFERRED EMBODIMENTS

Figure 1:
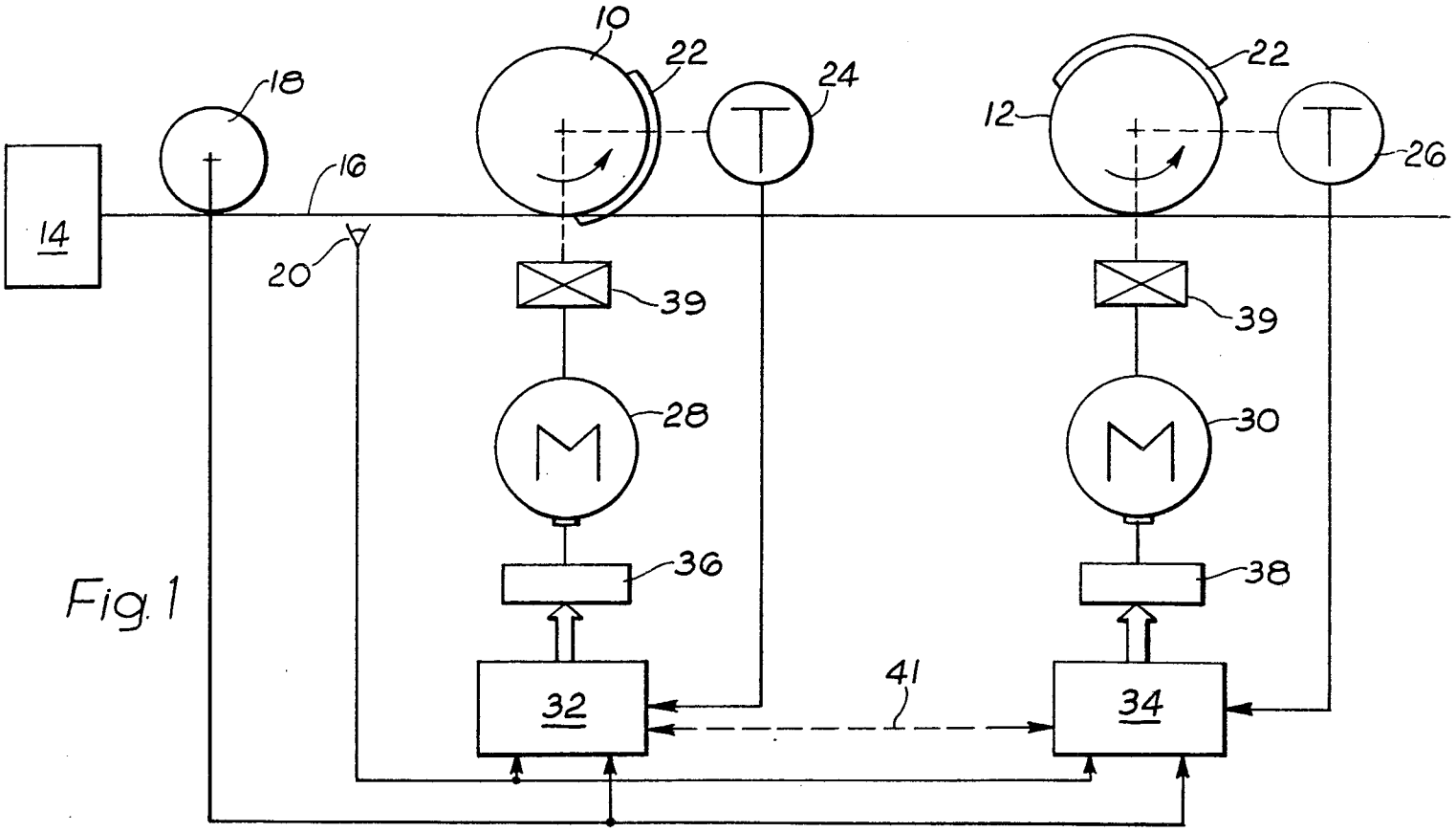
FIG. 1 is a schematic view of a die-cutting machine in accordance with the present invention.

Referring to FIG. 1, the die-cutting apparatus comprises 2 sets of die cutting rolls 10, 12 of which only the form-carrying rolls are illustrated, the counter-pressure rolls being omitted for the sake of clarity. Continuous preprinted web material is fed to the die cutters by a conventional feed mechanism 14 from a suitable supply along a path 16 so that the web material passes through the nips of the roll sets 10, 12 and is subjected to the die cutting action of the forms carried by the roll sets 10, 12.

In some cases, the continuous web will be preprinted with for example advertising matter which is to appear on the resulting blanks and to enable the die cutting to be synchronised with such printed matter, the web may be provided with print register marks which are spaced lengthwise of the web at intervals corresponding to the resulting blank length.

The feed mechanism 14 in use imparts a constant feed speed to the web and the web speed is measured by a suitable sensor such as a measuring wheel/pulse generator 18 which provides a pulse train representing the web speed. The print register marks on the web are detected by a sensor 20 which may comprise a photocell arrangement providing a signal each time a print register mark is detected.

The die cutting forms 22 carried by the roll sets 10, 12 may be conventional and their peripheral dimensions will correspond either individually or collectively to the desired blank length depending on whether the forms each die cut a complete blank or only half a blank, the two half blanks cut by the respective forms constituting a complete blank. A sensor 24, 26 is connected to the forme carrying roll of each roll set 10, 12 to provide an electrical output representing the instantaneous roll speed and also the instantaneous position of a datum position on the roll. The datum position for each roll may for example correspond to the leading edge of the respective forme. The sensors 24, 26 may be in the form of photoelectric pulse tachometers.

The counterpressure roll of each roll set may be driven from the same source as the feed mechanism so as to have constant peripheral speeds substantially the same as the web speed. The form carrying roll of each roll set on the other hand must be driven at variable speeds, as will be explained further below, and for this purpose each form carrying roll is driven by means of a respective high impulse duty variable speed D.C. motor 28, 30 under the control of computing units 32, 34. Electrical power is supplied to each motor 28, 30 by a high response thyristor drive 36, 38 and each motor may be reversible so that, when desired, the forme carrying rolls can be driven in reverse. The drive from each motor 28, 30 to the respective roll is via a gear reducing unit 39.

In a typical arrangement, the motors may comprise Reliance Super type RPM D.C. motors, the thyristor drives may comprise Reliance Maxitron S6R drives and the computing units may comprise Reliance Auto Mate 31ML programmable controlling units, all of which equipment is commercially available from the Reliance Electric Company of 24701 Euclid Avenue, Cleveland, Ohio, U.S.A. and subsidiaries thereof.

The electrical outputs of the sensors 18 and 20 are coupled to both computing units 32, 34 while the electrical outputs of sensors 24, 26 are coupled respectively to the computing units 32, 34 so that each computing unit 32, 34 is supplied with signals representing the web speed, print register mark detection and the instantaneous speed and datum position of the associated form carrying roll.

During the time that each form is diecutting it must travel with a peripheral speed substantially the same as the web speed. Each computer unit 32, 34 is therefore programmed to control the motors 28, 30 accordingly during this part of each roll cycle, the computing units being provided with data, e.g. via an operator console (not shown), representing the peripheral dimensions of the forme. This information together with the output signals from the sensors 18, 20, 22 and 24 enables the computing units to co-ordinate the speed of the rolls 10, 12 and the positions of the forms 22 with the respect to the web.

For the remaining part of each roll cycle, i.e. during which the form is disengaged from the web, the roll speed is varied, in dependence upon the peripheral dimensions of the form, in such a way that the rolls die cut alternate blanks with minimum or nil wastage between adjacent blanks. It will be understood that the speed variation pattern followed by each roll during this part of the cycle will be governed by the peripheral extent of the form. Where the form extends over a major part of the roll periphery, to maintain co-ordination between the rolls 10, 12 it will be necessary to initially slow down the roll during the non-cutting phase and possibly bring it to a standstill or even run it in reverse for part of the time and then speed up the roll again until the peripheral roll speed is substantially the same as web speed immediately prior to commencement of the next die cut. On the other hand, where the forme extends over only a minor part of the roll periphery a different pattern of speed variation is called for in that it will be necessary to speed up the roll initially and thereafter slow it down so that the peripheral roll speed is again substantially equal to web speed at the instant web cutting is again commenced.

The computing units are programmed with a desired speed variation pattern corresponding to the forme size in use and are operable to continually compare the instantaneous roll speeds and positions with the programmed pattern of speed variation and, with the aid of the feedback signals, to control the D.C. motors so that the actual roll speed variation corresponds to the desired roll speed pattern. Thus, if the actual roll speed at a given roll position deviated from the programme speed for the roll at that position, the current supply from the thyristor drive 36 to the associated motor is adjusted to correct for the deviation. This monitoring and correction process will be carried out repeatedly, for example many times per second, so that the actual roll speed variation is made to conform very closely to the programmed roll speed variation for the form size employed.

The computing units 32, 34 may in fact form parts of a single unit or be linked together, e.g. as indicated by line 41, so that the forme carrying rolls operate in timed relation. To maintain proper registry between the die cuts and preprinted areas on the blanks or to compensate for example for any web stretching or shrinkage that may occur and which would tend to cause the die cut areas to progressively advance or lag behind with respect to the preprinted areas, one or the other of the computing units 32, 34 is arranged to compare the relative positions of the print register marks, as sensed by the sensor 20, with the datum position on the respective form. The computing unit concerned is arranged, in the event of detecting misregistration, to automatically adjust the respective roll either temporarily or permanently, depending on the nature of the fault causing misregistration, so that die cutting commences earlier or later. The other computing unit is arranged to respond to such adjustments to maintain the correct timed relation between the two form carrying rolls.

Figure 2:
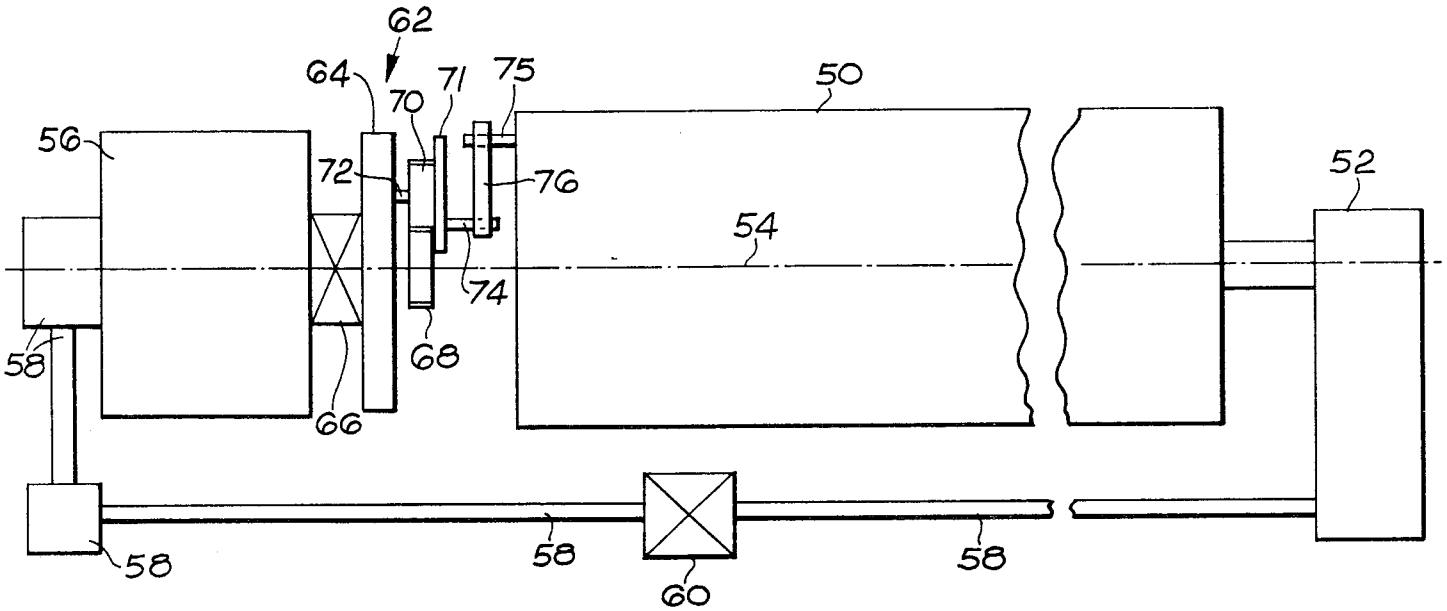
FIG. 2 is a schematic view showing a simplified auxiliary roll speed regulating arrangement.

Reference is now made to FIG. 2 which shows in diagrammatic form a simplified form of auxiliary arrangement for retarding or accelerating each die cutting roll independently of the variable speed D.C. motor drive. Both rolls will be provided with such an arrangement and only one will therefore be described.

The roll 50 (which corresponds for example to the roll 10 shown in FIG. 1) is driven, as previously explained, by the computer controlled variable speed D.C. motor drive which is designated generally by reference numeral 52, the rotational axis of the roll 50 being depicted by reference numeral 54. A flywheel 56 is mounted co-axially with the roll 50 and is driven rotatably directly from the D.C. drive via transmission components 58 when clutch 60 is operative so that, in this simplified case, the flywheel rotates at the same speed as the roll. The clutch 60 can be rendered inoperative to disconnect the flywheel 56 from the direct D.C. drive when required and while the clutch 60 is inoperative the flywheel may be coupled to the roll 50 via an energy transferring coupling 62 which will now be described.

The coupling comprises a rotary carrier 64 which is connected to the flywheel 56 via a clutch 66 and is rotatable above the axis 54. The carrier 64 mounts a pair of meshing gears 68, 70. The gear 68 is coaxial with axis 54 and is normally held fixed against rotation. The gear 70 is free to rotate about its axis 72 and has a disc 71 rotatably fast therewith, the disc 71 being provided with a throw or crank pin 74. The crank pin 74 is connected to a crank pin 75 on the end face of the roll 50 by a connecting rod 76. The gear ratio between the gears 68 and 70 is such that the gear 70 turns one or more complete revolutions for one complete orbit of the axis 72 about axis 54. For present purposes, a gear ratio of one to one will be assumed.

Figure 3:
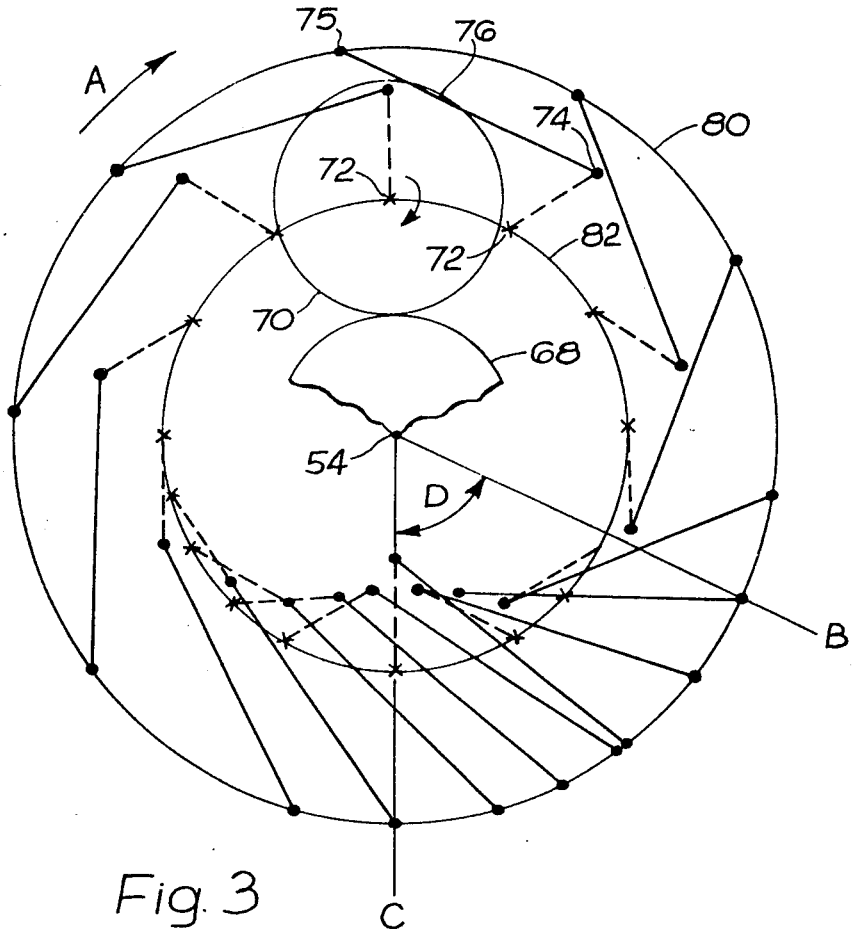
FIG. 3 illustrates operation of the regulating arrangement shown in FIG. 2.

FIG. 3 illustrates various positions of the connecting rod 76 and associated crank pins 74, 75 during the course of one complete revolution of the roll 50, the direction of rotation being indicated by arrow A. The crank pin 75 follows a circular path 80 and the axis 72 about which gear 70 rotates follows a circular path 82. During one complete revolution of the roll 50, the gear 70 will execute a complete revolution resulting in a variable transmission of drive from the roll 50 to the carrier 64 via connecting rod 76 and gear 70. At certain angular positions of the roll, depicted by references B and C, the connecting rod 76 passes through the axis 72 and at such a position, the instantaneous rotational speeds of the roll 50 and carrier 64 will be the same.

As the crank pin 75 moves through the angle D from position B to position C, it will be observed that the axis 72 advances with respect to the crank pin 75 and, as a consequence, the carrier speed will exceed the roll speed during this part of each revolution of the roll 50. Moreover, the rate of advance of the axis 72 is greater over a zone midway between the positions B and C with a correspondingly sharp increase in carrier speed relative to the roll speed.

Beyond position C, the crank pin 75 advances relative to the axis 72 and the roll speed exceeds the carrier speed until the crank pin 75 reaches position B again at which time the carrier speed matches the roll speed and thereafter exceeds the roll speed until the crank pin 75 reaches a position C.

The arrangement is such that the angle D can correspond to the circumferential extent of the roll 50 which is not occupied by the form (not shown) carried by the roll 50, i.e. the positions C and B correspond respectively to the trailing and leading edges of the form, i.e. during the period that the form is disengaged from the web, the crank pin 75 is moving from position B to position C and, during die cutting, the crank pin 75 moves clockwise from position C to position B.

The mass of the components forming the coupling assembly 62 is relatively small compared with the masses of the roll 50 and the flywheel 56 and the variation of the carrier speed will not have any significant effect on roll speed while the clutch 66 is disengaged. The operation of the clutches 60 and 66 is coordinated with rotation of the roll 50 in such a way that clutch 60 is engaged and clutch 66 is disengaged while the crank pin 75 is moving clockwise from position C to position B whereas clutch 60 is disengaged and clutch 66 is engaged while the crank pin 75 is moving clockwise from position B to position C. Operation of the clutches 60 and 66 may be controlled by the computing unit 32 associated with respective roll 50, the clutches 60 and 66 being operated at those positions in which the roll speed and carrier speed are substantially equal, i.e. at positions B and C in FIG. 3.

It will be seen from the foregoing that while the form of the roll is engaged with the web the flywheel 56 is connected to the drive source 52 via clutch 60. For the remaining part of the roll cycle, the flywheel 56 is coupled to the roll 50 via the coupling assembly 62 and the changeover of drive transmission via clutches 60 and 66 is effected at instants when the roll speed, carrier speed and flywheel speed are substantially the same. By connecting the roll 50 to the flywheel 56 over angle D, the coupling assembly 62 tends to speed up the flywheel sharply and to conserve angular momentum, the roll speed is correspondingly reduced.

Thus, the roll 50 is subjected to a braking action which supplements the braking action of the D.C. motor and the electrical power drawn by the D.C. motor to effect braking of the roll 50 is correspondingly reduced. Midway through the angle D, the increased speed imparted to the carrier and hence the flywheel reaches a peak and thereafter the relative speeds will converge until they are equal at position C at which time the clutch 66 is disengaged and the clutch 60 is engaged. Thus, over the angle D initially a surge of rotational energy is transferred from the roll 50 to the flywheel and subsequently after said peak has been attained, rotational energy is transferred back from the flywheel to the roll.

As described previously, the electrical power supplied to the D.C. motor associated with each form carrying roll is determined by the respective computing unit in dependence upon the feedback signals from the roll speed/position sensors 24, 26. In the absence of the flywheel 56 and coupling 62, impulse currents of large magnitude will be necessary to control the roll speed when the form thereof is disengaged from the web especially when the form extends over a major part of the roll periphery. However, because of the transfer of rotational energy between the roll and the flywheel during this period, the magnitude of the impulse currents is reduced thereby conserving electrical power which would otherwise be dissipated in the form of heat and reducing the magnitudes of the impulse currents required thus leading to a smoother operation. In addition, it is possible to employ 52 KW or 85 KW D.C. motors which are commercially available whereas larger and considerably more expensive motors would be necessary to control the rolls if no auxiliary roll speed means is employed.

Although the above description is given in terms of an arrangement in which the forms extend over a major part of the roll periphery, hence necessitating an increase in flywheel speed relative to roll speed over the angle D, it will be understood that the invention is applicable also to forms of relatively small peripheral extent such that the roll has to be speeded up during the time that the form is disengaged from the web. In this event, the coupling 62 is arranged so that, during the form disengaged period, rotational energy is initially transferred from the flywheel to the roll and then transferred back.

A more practical embodiment of the invention is shown in FIGS. 4–8 to which reference will now be made. Some components shown in FIGS. 4–8 are the counterparts of certain components shown in FIGS. 2 and 3 and these components will be designated by the same reference numerals.

Reference numeral 100 depicts various supporting columns for mounting the rotary components of the machine. The roll 50 is driven, via gears 102, 104, by the D.C. motor drive 52. The flywheel 56 is coaxial with the roll 50 and is constructed in the manner of a governor comprising large spherical masses 106 mounted on arms 108 connected pivotally to axially adjustable blocks 110. The radial positions of the masses 106 are dictated by the spacing of the blocks 110 in the axial direction thus enabling the moment of inertia of the flywheel to be varied as desired, either when stationary or possibly while rotating. In some circumstances, it will be desirable for the flywheel to have different rotational energies for a given speed of rotation and this can be achieved either by the arrangement shown in FIG. 4 or, alternatively, by providing a number of different sized flywheels, the flywheels size being selected according to requirements.

The flywheel 56 is driven from the roll 50 via gears 112, 114, 116, 118 and clutch 60 which, as explained in connection with FIG. 2, will be engaged during the time that the roll is effecting die cutting. During the non-cutting part of the cycle, clutch 60 is disengaged and clutch 66 is engaged so that drive from the roll to the flywheel is through the coupling mechanism 62 and gears 118–124. The ratios of gears 112, 118 and 114, 116 may be such that when clutch 60 is operative, i.e. during the constant speed part of the roll cycle, the flywheel speed differs from the roll speed but is matched thereto in the sense that the gears 112, 114 rotate at the same speed. Similarly the ratios of gears 122, 124 and 118, 120 may be such that the flywheel speed differs from but is matched to roll speed so that when the carrier 64 (which is constituted by the gears 122) is rotating at roll speed, the gears 120, 124 have the same rotary speeds. The clutches 60, 66 can therefore be changed over when gear pairs 120, 124 and 112, 114 have the same rotary speeds even though the flywheel speed may differ substantially from the roll speed. Such clutch changeovers will be effected at instants corresponding to positions B and C in FIG. 3. The clutches 60 and 66 are shown diagrammatically and may be electromagnetic clutches in practice.

The coupling mechanism 62 in FIGS. 4 to 8 is more elaborate than that shown in FIG. 2 in order to allow wide variations to be made to the angle D and, for this purpose, the connecting rod 76 is adjustable in length, the spacing between the axis 72 of gear 70 and the main axis 54 can be varied and the eccentricity of the crank pin 74 is adjustable relative to the axis 72.

Figure 8:
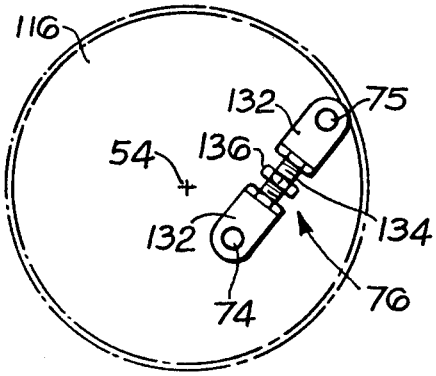

Thus, with reference to FIG. 8, the connecting rod 76 comprises two end pieces 132 connected by a screwthreaded rod 134 having screwthreaded portions of opposite hand cooperating with the end pieces 132 so that turning of the rod 134 by means of nut 136 fixed on the rod 134 enables the spacing between end pieces 132 to be varied depending upon the sense of rotation of rod 134.

Figure 5:
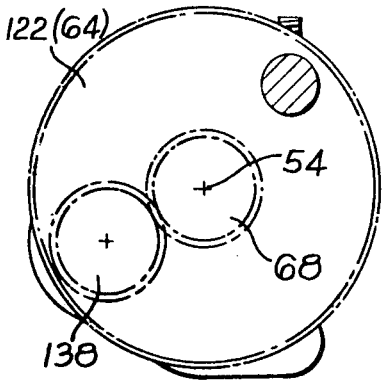
FIGS. 5, 6, 7 and 8 are sectional views taken in the directions AA, BB, CC and DD on FIG. 4.
Figure 6:
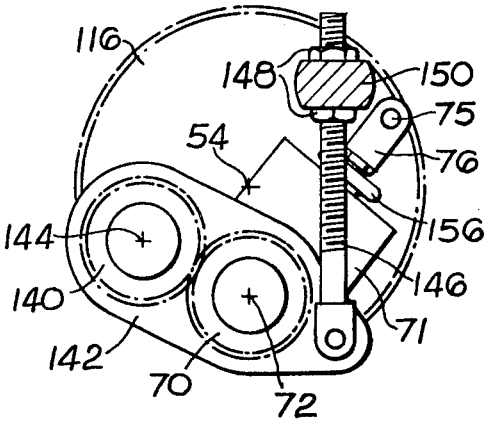
Figure 7:
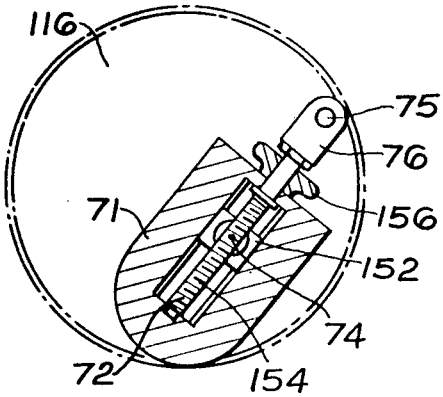

To enable the distance between the axes 72 and 54 to be adjusted, the gears 68 and 70 are not in direct mesh but instead are drivingly connected through intermediate gears 138, 140 (see FIGS. 5 and 6) which are rotatably fast with each other. The gear 70 is mounted on a carrier 142 which is pivotally adjustable about axis 144 under the control of a screwthreaded rod 146 whose upper end (as seen in FIG. 6) is held in a selected position of adjustment by nuts 148 and bracket 150 which is screwed to the carrier 64.

The crank pin 74 is mounted on block 152 which is slidably engaged on the plate 71 fast with gear 70. Adjustment of the block 152 is effected by rotating a screwthreaded rod 154 by means of knob 156. At one extreme position of adjustment of block 152, the crank pin 74 may be coaxial with the axis 72 so that the carrier 64 can then be driven at the same speed as the roll throughout the roll cycle.

The operation of the coupling mechanism 62 in FIGS. 4 to 8 is substantially as described with reference to FIGS. 2 and 3. In this embodiment however it will be seen that the various adjustments that are possible enable the coupling mechanism 62 to be adapted to changes in the peripheral length of the form. Also the fact that the flywheel is adjustable affords greater flexibility. When adjustments are made, it will be usually necessary to adjust the timing relation between gear 70 and the crank pin 75 and for this reason the normally fixed gear 68 may be adjustable angularly to achieve correct timing of the gear 70 with the roll.

The arrangement of the coupling mechanism 62 described above is intended for circumstances in which the roll speed is to be reduced during the non-cutting part of the cycle, e.g. where the form extends over more than 180° of arc. When the non-cutting part of the cycle is large, i.e. a small form, the coupling mechanism can be modified so that, in effect, the crank pin 75 rotates with the flywheel (instead of with the roll 50) and the crank pin 74 and associated components rotate with the roll.

Figure 4:
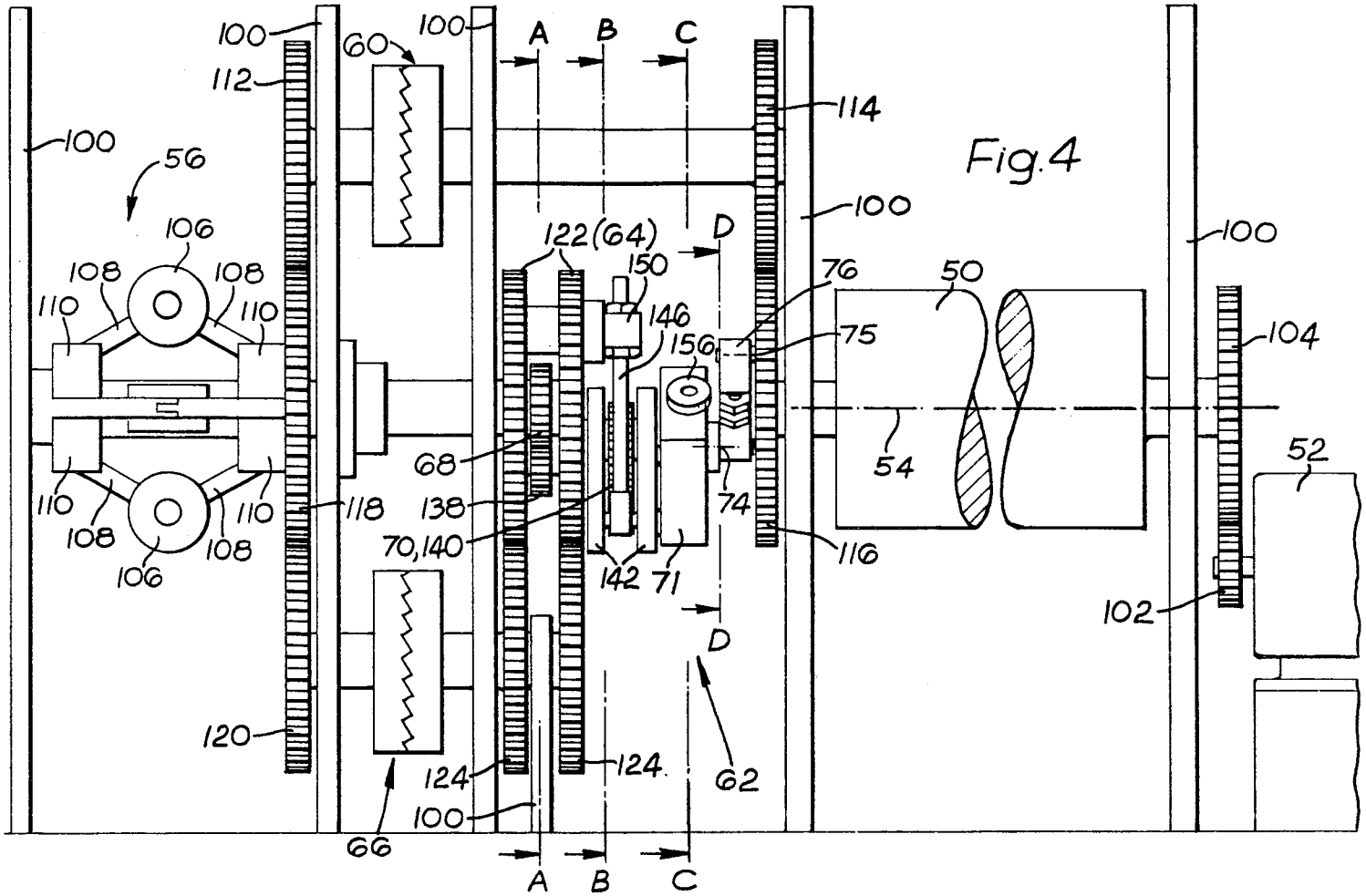
FIG. 4 is an end view of a die cutting machine having a more practical form of coupling mechanism between the roll and flywheel than that shown in the embodiment of FIG. 2.
Figure 9:
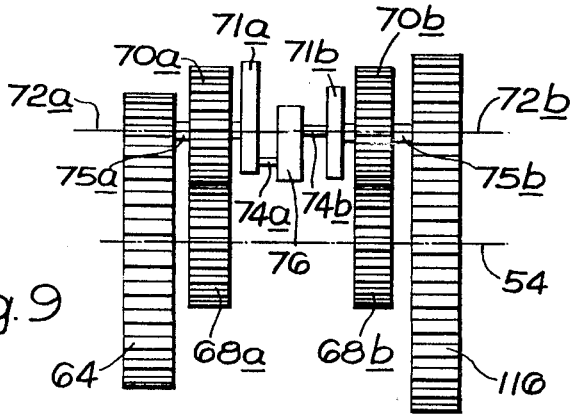
FIG. 9 is a schematic view of another form of coupling mechanism for use in the embodiment of FIG. 2 or FIG. 4.

FIG. 9 illustrates schematically a more elaborate version of the coupling mechanism 62 which can be adjusted either to reduce roll speed or to increase it during the non-cutting part of the cycle, depending on the peripheral length of the form. This mechanism will be essentially the same as disclosed in FIGS. 2 to 8 except that there will be two sets of components, one set being suffixed with reference a and being associated with the flywheel 56 and the other set being suffixed by reference b and being associated with the roll 50. Otherwise the reference numerals are the same as used in FIGS. 2 to 8 and while shown diagrammatically, the components will be adjustable as described with reference to FIGS. 4 to 8. Thus, for example, the connecting rod 76 (which will be common to both sets) will be adjustable and the gears 68, 70 will form part of a three-form gear system as shown in FIGS. 5 and 6.

The mechanism of FIG. 9 will be essentially the same as that shown in FIGS. 2 to 8 when the pin **74*b* is coaxial with the axis 72*b* (which is shown as if coaxial with axis 72*a* to aid clarity but will usually be offset from axis 72*a*). Thus, in this condition of adjustment the coupling mechanism can be used to extract energy from the roll 50 in the manner described with reference to FIG. 3. On the other hand, when pin 74*a* is coaxial with axis 72*a* and pin 74*b* is eccentric with respect to axis 72*b***, the mechanism can be used to increase roll speed during the non-cutting part of the roll cycle.

Although the flywheel and coupling mechanism arrangements described above with reference to FIGS. 2 to 9 are particularly useful for use in die-cutting machines in which the die-cutting rolls are driven by a direct D.C. motor drive, it is envisaged that they will also be applicable to other die-cutting machines in which the drive is for example purely mechanical in order to assist retardation and acceleration of the die cutting rolls during the non-cutting part of the roll cycle.

From the foregoing, it will be noted that the coupling mechanism 62 allows transfer of energy between two rotating parts in order to vary the relative speeds thereof. Such a coupling mechanism could therefore be used as part of the drive transmission between the drive source, for example a constant speed drive source, and a respective die cutting roll and this possibility is illustrated schematically in FIG. 10 to which reference is now made.

Figure 10:
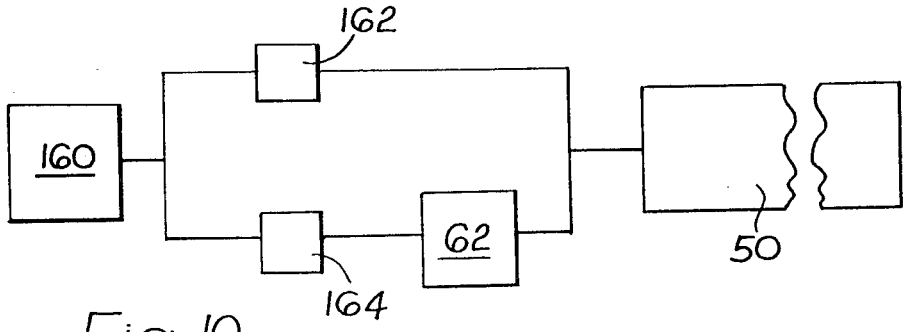
FIG. 10 is a diagrammatic view of a further embodiment of the invention.

In FIG. 10, the transmission of rotary drive from the constant drive source 160 to the roll 50 takes place, during the die-cutting portion of the roll cycle, via clutch 162 whereas, during the non-cutting part of the roll cycle, drive transmission takes place through clutch 164 and a coupling mechanism 62 of the form described with reference to FIGS. 2, 4 or 9, the mechanism 62 being adjusted in such a way that the roll 50 is either speeded up or slowed down only during the non-cutting part of the cycle to such an extent that proper synchronism is maintained between cutting of the blanks by the two sets of die cutting rolls. The machine of FIG. 10 may, in addition, include a flywheel and coupling arrangement of the form described with reference to FIGS. 2 to 9.

Although the foregoing description has been concerned primarily with the die cutting of blanks, the invention is applicable to other forms of web treatment by two or more roll sets, for example printing of web material.

I claim:

1. A machine for treating continuous web to produce a series of longitudinally successive blanks, comprising at least two sets of treatment rolls each including a form-carrying roll for cooperation with the web, and means for feeding the web at a substantially constant speed successively through the nips of said roll sets, wherein the improvement comprises (a) a variable speed electrical motor connected to drive each form-carrying roll through a constant speed transmission, (b) a sensor connected to each form-carrying roll which provides an electrical output representing the instantaneous roll speed and the location of a datum position on the roll, (c) a programmable computer, responsive to the electrical output of said sensor, which controls the speed of each variable speed electrical motor to drive the connected form-carrying roll at a constant speed while the form engages the web, and at a programmed varying speed during the remainder of each revolution of the roll to maintain close spacing of the successive blanks produced by the form-carrying rolls, and (d) means associated with each form-carrying roll for transmitting energy in a selected direction between said transmitting means and said roll during said remainder of each revolution of said roll to assist the connected motor in varying the speed of said roll.

2. A machine as claimed in claim 1 in which each said transmitting means comprises a flywheel, means for rotating the flywheel at a constant speed matched to the speed of rotation of the associated roll while the form carried by said roll engages the web, and means for coupling said roll to the flywheel during the remainder of each revolution of the roll, said coupling means operating to vary the speed of said roll relative to the speed of the flywheel.

3. A machine as claimed in claim 2 in which the flywheel is adjustable to vary its moment of inertia.

4. A machine as claimed in claim 1 in which each roll set includes a counterpressure roll forming a nip with the form-carrying roll and in which said counterpressure rolls are driven at a constant peripheral speed substantially equal to the web speed.

5. A machine as claimed in claim 1, 2 or 3 including means for sensing print register marks provided on the web to indicate the boundaries of preprinted areas on the web, said computer being responsive to said mark sensing means to maintain registry between the forms and said preprinted areas.

6. A machine as claimed in claim 2 or 3 in which said coupling means comprises first and second rotary carriers coaxial with said roll, a rotor mounted on the first carrier for rotation about an axis parallel to the roll axis and carrying a member which is adjustable to vary its position on the rotor, said rotor having a drive which causes it to execute at least one complete revolution for each revolution of said first carrier, a connecting member which links said adjustable member to a member located on the second carrier, and a clutch for connecting one of the carriers to the flywheel while the form is out of engagement with the web, the other carrier being joined to the roll.

7. A machine as claimed in claim 2 or 3 in which said coupling means comprises first and second rotary carriers coaxial with said roll, a rotor mounted on each carrier for rotation about an axis parallel to the roll axis, each rotor carrying a member which is adjustable to vary its position on the rotor, each rotor having a drive which causes it to execute at least one complete revolution for each revolution of its carrier, a connecting member which links said adjustable members, and a clutch for connecting one of said carriers to the flywheel while the form is out of engagement with the web, the other carrier being joined to the roll, and each of said members being adjustable into a position coaxial with the corresponding rotor.

8. A machine as claimed in claim 6 in which the axis of rotation of the rotor is adjustable radially of the roll axis.

9. A machine as claimed in claim 6 in which said connecting member is of adjustable length.

10. A machine for treating continuous web to produce a series of longitudinally successive blanks, comprising a set of treatment rolls including a roll carrying web-treating means, and means for feeding the web at a predetermined speed through the nip of said roll set, wherein the improvement comprises (a) a variable speed electrical motor connected to drive said carrying roll through a constant speed transmission, (b) a sensor connected to said roll which provides an electrical output representing the instantaneous roll speed and the location of a datum position on the roll, (c) a programmable computer, responsive to the electrical output of said sensor, which controls the speed of said motor to drive said roll at a constant speed while said web-treating means engages the web, and at a programmed varying speed during the remainder of each revolution of the roll to maintain close spacing of the successive blanks, and (d) means associated with said roll for transmitting energy in a selected direction between said transmitting means and said roll during said remainder of each revolution of said roll to assist said motor in varying the speed of said roll.

11. A machine as claimed in claim 1 or 10 in which the means for transmitting energy is adjustable to vary the quantity of energy transmitted.

* * * * *